US011735843B2

(12) United States Patent
Lee et al.

(10) Patent No.: US 11,735,843 B2
(45) Date of Patent: Aug. 22, 2023

(54) CONNECTOR AND MANUFACTURING METHOD THEREOF

(71) Applicant: PEGATRON CORPORATION, Taipei (TW)

(72) Inventors: Yung-Tai Lee, Taipei (TW); Kai-Wen Lee, Taipei (TW); Tse-Hao Yang, Taipei (TW); Yen-Yen Chiu, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 202 days.

(21) Appl. No.: 17/401,366

(22) Filed: Aug. 13, 2021

(65) Prior Publication Data

US 2022/0109257 A1 Apr. 7, 2022

(30) Foreign Application Priority Data

Oct. 7, 2020 (TW) ..... 109134858

(51) Int. Cl.
*H01R 12/70* (2011.01)
*H01B 17/30* (2006.01)
(Continued)

(52) U.S. Cl.
CPC ..... *H01R 12/7011* (2013.01); *H01B 17/20* (2013.01); *H01B 17/305* (2013.01);
(Continued)

(58) Field of Classification Search
CPC ..... H01R 12/7011; H01R 43/0256; H01R 2201/00; H01R 12/707; H01R 13/521;
(Continued)

(56) References Cited

U.S. PATENT DOCUMENTS 9,431,759 B2 * 8/2016 Hirano ..... G11B 33/122

FOREIGN PATENT DOCUMENTS

DE 102018120893 B4 * 1/2022 ..... G02B 6/12033
EP 1791198 A2 * 5/2007 ..... H01M 2/22
(Continued)

OTHER PUBLICATIONS

Machine Translation GB 2543734 A, (May 3, 2017) (Year: 2023).*
Machine Translation DE 102018120893 B4, (Jan. 27, 2022) (Year: 2023).*

*Primary Examiner* — Travis S Chambers
(74) *Attorney, Agent, or Firm* — McClure, Qualey & Rodack, LLP

(57) ABSTRACT

Provided are a connector and a manufacturing method thereof. The connector is configured to dispose on a circuit board including a mounting hole. The connector includes a guide pin module and a conductive cover. The guide pin module is located on one side of the circuit board and includes a base, a metal guide pin, and a glass sealing layer. The base has a perforation hole corresponding to the mounting hole. The metal guide pin is inserted into the perforation hole and the mounting hole. The glass sealing layer is disposed at the perforation hole and wraps around part of the metal guide pin. The conductive cover is disposed at the mounting hole, connected to the top of the metal guide pin, and protrudes from the circuit board. The conductive cover is bonded to the circuit board by soldering to electrically connect the metal guide pin to the circuit board.

14 Claims, 4 Drawing Sheets

(51) Int. Cl.
*H01B 17/20* (2006.01)
*H01R 43/02* (2006.01)
*H01B 17/62* (2006.01)

(52) U.S. Cl.
CPC ..... *H01B 17/62* (2013.01); *H01R 43/0256* (2013.01); *H01R 2201/00* (2013.01)

(58) Field of Classification Search
CPC ..... H01R 4/625; H01B 17/20; H01B 17/305; H01B 17/62
See application file for complete search history.

(56) References Cited

FOREIGN PATENT DOCUMENTS

| | | | | | |
|---|---|---|---|---|---|
| EP | 1743347 | B1 * | 6/2013 | ..... | A61N 1/3754 |
| GB | 2543734 | A * | 5/2017 | ..... | G06F 30/39 |
| WO | WO-2009086435 | A2 * | 7/2009 | ..... | G11B 33/123 |

* cited by examiner

CONNECTOR AND MANUFACTURING METHOD THEREOF

CROSS-REFERENCE TO RELATED APPLICATION

This non-provisional application claims priority under 35 U.S.C. § 119(a) to Patent Application No. 109134858 filed in Taiwan, R.O.C. on Oct. 7, 2020, the entire contents of which are hereby incorporated by reference.

BACKGROUND

Technical Field

The application relates to a connector and a manufacturing method thereof, and in particular, to a connector applicable to wearable products and a manufacturing method thereof.

Related Art

A glass to metal seal (GTMS) structure is an airtight structure that can be electrically conductive formed by sintering alloy metal and glass, which is frequently applied to a connection terminal that needs to be airtight in an extremely harsh environment. When the GTMS is applied in a connector module, a guide pin needs to be in contact with or soldered to an external circuit. When applied to wearable products, the guide pin side needs to be electrically connected to a circuit board. In consideration of reliability test such as product drop, the circuit board and the guide pin are electrically connected by soldering. However, in consideration of biocompatibility of wearable devices when coming into contact with human bodies, stainless steel (such as SUS316) or a niobium alloy needs to be used as a material of the guide pin. However, the stainless steel and the niobium alloy cannot be in direct contact with the circuit board through a conventional soldering technique (solder paste soldering) to achieve an electrical connection.

SUMMARY

In an embodiment, the application provides a connector configured to be disposed on a circuit board, and the circuit board includes a mounting hole. The connector includes a guide pin module and a conductive cover. The guide pin module is located on one side of the circuit board and includes a base, a metal guide pin, and a glass sealing layer. The base has a perforation hole corresponding to the mounting hole, and the metal guide pin is inserted into the perforation hole and the mounting hole. The glass sealing layer is disposed at the perforation hole and wraps around part of the metal guide pin. The conductive cover is disposed at the mounting hole, connected to the top of the metal guide pin, and protruding from the circuit board, where the conductive cover is bonded to the circuit board by soldering, so that the metal guide pin is electrically connected to the circuit board through the conductive cover.

In some embodiments, the conductive cover is made of zinc-tin-nickel alloy.

In some embodiments, the metal guide pin is made of stainless steel or a niobium alloy.

In some embodiments, the conductive cover is made of a high temperature resistant, non-oxidizing, and solderable material.

In some embodiments, the conductive cover is connected to the top of the metal guide pin through laser spot welding.

In some embodiments, during the soldering, a lead-free solder paste is applied to a periphery of the conductive cover, and after the lead-free solder paste is melted, the melted lead-free solder paste flows around and fills the mounting hole and comes into contact with the circuit board, so as to form an electrical connection among the circuit board, the conductive cover, and the metal guide pin.

In some embodiments, the guide pin module further includes an insulating layer disposed above the glass sealing layer, surrounding the metal guide pin, and shielding the perforation hole.

In another embodiment, the application provides a manufacturing method of the connector, including: providing a guide pin module, where the guide pin module includes a base, a metal guide pin, and a glass sealing layer, where the base has a perforation hole, the metal guide pin is inserted into the perforation hole, and the glass sealing layer is disposed at the perforation hole and wraps around part of the metal guide pin; providing a circuit board on one side of the guide pin module, where the circuit board includes a mounting hole corresponding to the perforation hole, and the metal guide pin is inserted into the mounting hole; disposing a conductive cover at the mounting hole, where the conductive cover is connected to the top of the metal guide pin and protrudes from the circuit board; and performing a soldering step to bond the conductive cover to the circuit board, so that the metal guide pin is electrically connected to the circuit board through the conductive cover.

In some embodiments, the conductive cover is made of zinc-tin-nickel alloy.

In some embodiments, the metal guide pin is made of stainless steel or a niobium alloy.

In some embodiments, the conductive cover is made of a high temperature resistant, non-oxidizing, and solderable material.

In some embodiments, the conductive cover is connected to the top of the metal guide pin through laser spot welding.

In some embodiments, the soldering step includes: applying a lead-free solder paste to a periphery of the conductive cover; and melting the lead-free solder paste through heating, where after the lead-free solder paste is melted, the melted lead-free solder paste flows around and fills the mounting hole and comes into contact with the circuit board, so as to form an electrical connection among the circuit board, the conductive cover, and the metal guide pin.

In some embodiments, the guide pin module further includes an insulating layer disposed above the glass sealing layer, surrounding the metal guide pin, and shielding the perforation hole.

In conclusion, the connector and the manufacturing method of the connector of the application are applicable to processing and manufacturing of a guide pin module having a glass-to-metal seal (GTMS) structure. The manufactured connector can have biocompatibility, air tightness, and electrical performance. In addition, by adding the conductive cover between the guide pin module and the circuit board, even if a metal guide pin made of stainless steel or a niobium alloy is used, the circuit board can be electrically connected to the conductive cover and the metal guide pin of the guide pin module by soldering.

Specific features and advantages of the application are described in detail in the following implementations, of which content is sufficient to enable any person skilled in the related art to understand and hereby implement technical content of the application. In addition, according to the content disclosed in this specification, the claims, and the drawings, a person skilled in the related art can easily understand related purposes and advantages of the application.

DETAIL DESCRIPTION OF THE EMBODIMENTS

Figure 1:
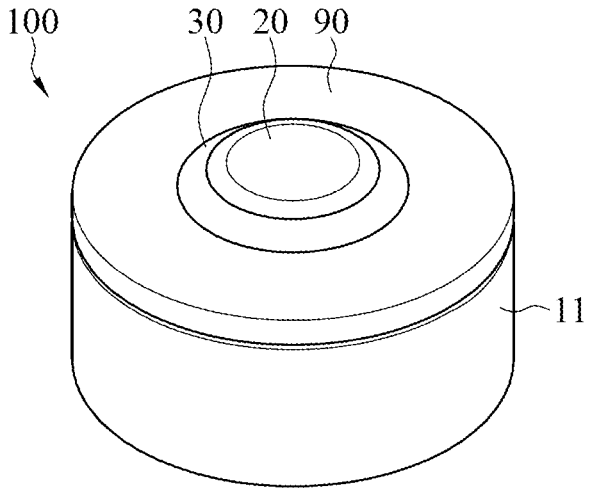
FIG. 1 is a partial schematic diagram of a connector according to a first embodiment of the application.
Figure 2:
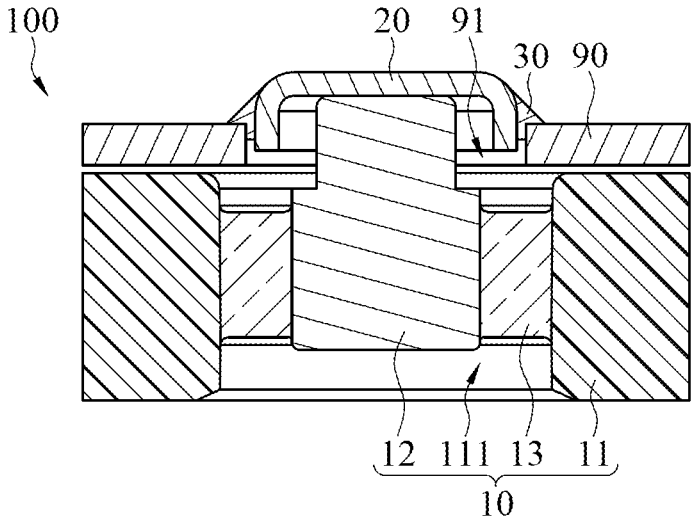
FIG. 2 is a partial cross-sectional view of the connector according to the first embodiment of the application.
Figure 3:
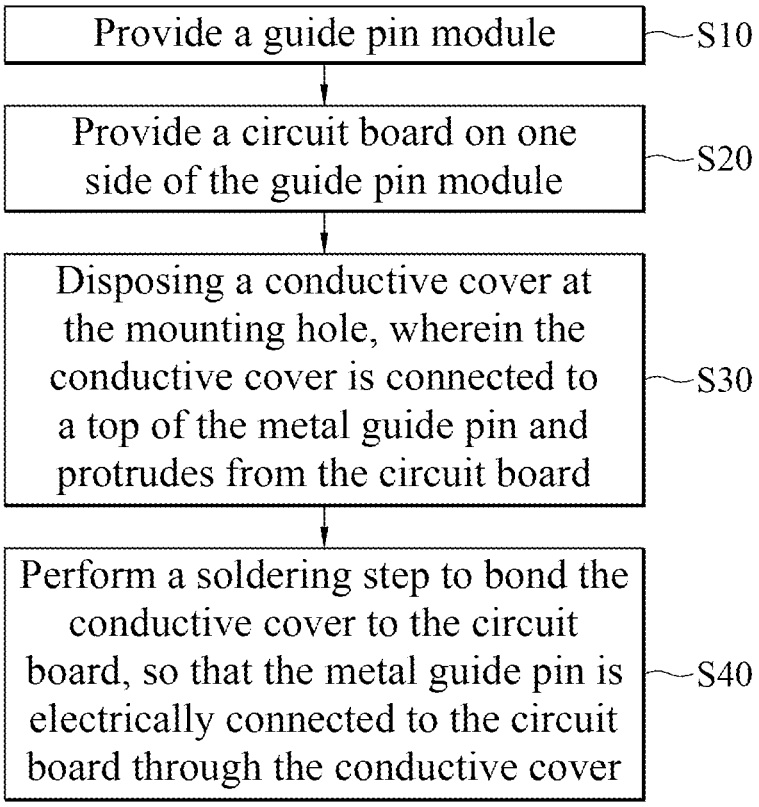
FIG. 3 is a flowchart of a manufacturing method of the connector according to the first embodiment of the application.
Figure 4:
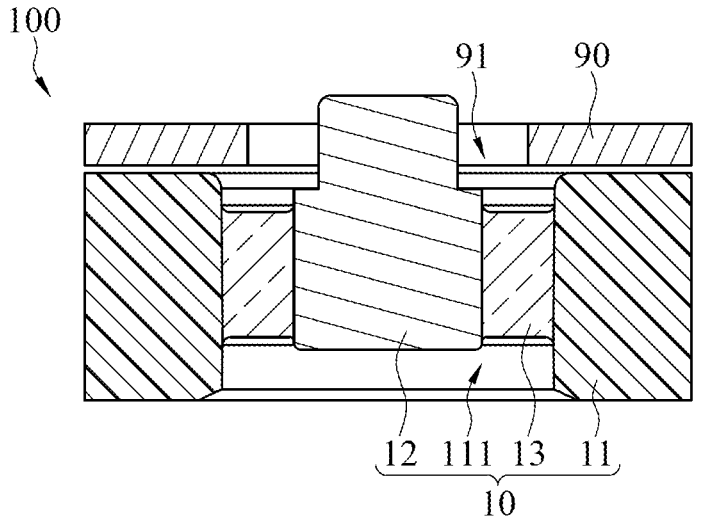
FIG. 4 is a schematic diagram (I) of the connector manufactured in the first embodiment of the application.
Figure 5:
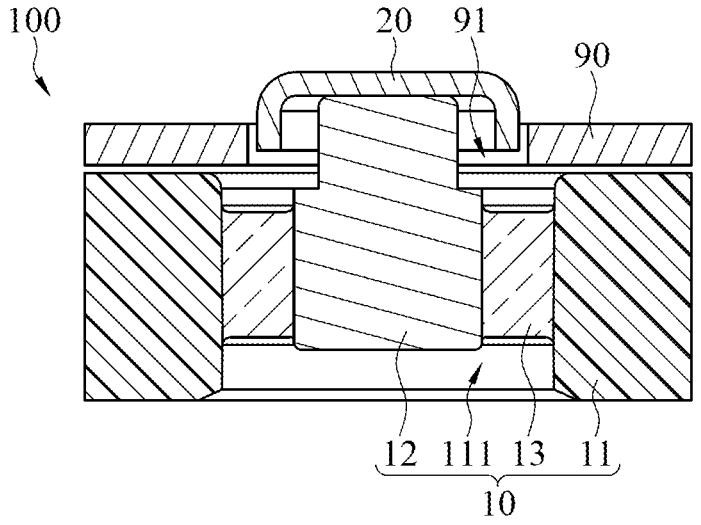
FIG. 5 is a schematic diagram (II) of the connector manufactured in the first embodiment of the application.

FIG. 1 is a partial schematic diagram of a connector according to a first embodiment of the application. FIG. 2 is a partial cross-sectional view of the connector according to the first embodiment of the application. FIG. 3 is a flowchart of a manufacturing method of the connector according to the first embodiment of the application. FIG. 4 is a schematic diagram (I) of the connector manufactured in the first embodiment of the application. FIG. 5 is a schematic diagram (II) of the connector manufactured in the first embodiment of the application. Referring to FIG. 1 and FIG. 2, a connector 100 in this embodiment is configured to be soldered to a circuit board 90, and the circuit board 90 includes at least one mounting hole 91. In this embodiment, for ease of description, one mounting hole 91 is exemplified. However, it may be understood that one or more mounting holes 91 may be disposed on the circuit board 90 to assemble a required number of connectors 100.

The connector 100 includes a guide pin module 10 and a conductive cover 20. The guide pin module 10 is located on one side of the circuit board 90 and includes a base 11, a metal guide pin 12, and a glass sealing layer 13. The base 11 has at least one perforation hole 111. A position of the perforation hole 111 corresponds to a position of the mounting hole 91. In this embodiment, for ease of description, one perforation hole 111 is exemplified. However, it may be understood that one or more perforation holes 111 may be disposed on the base 11 to assemble a required number of metal guide pins 12. The metal guide pin 12 is inserted into the perforation hole 111 and the mounting hole 91. The metal guide pin 12 may be made of stainless steel (such as SUS316) or a niobium alloy, and may be disposed according to a required number. In this embodiment, one metal guide pin is exemplified. In addition, a top end of the metal guide pin 12 extending through the perforation hole 111 may protrude from an upper surface of the base 11, so that the metal guide pin 12 can still be electrically connected to an electronic contact of a subsequent matching electronic element after the circuit board 90 is mounted.

The glass sealing layer 13 is disposed at the perforation hole 111 and wraps around part of the metal guide pin 12. In order to provide the guide pin module 10 with good airtightness, a glass sealing layer 13 is sintered between the metal guide pin 12 and the base 11 to fill the perforation hole 111 and wrap the metal guide pin 12. In this way, liquid or moisture cannot enter through the perforation hole 111.

The conductive cover 20 is disposed at the mounting hole 91 and connected to and fixed on the top of the metal guide pin 12. The circuit board 90 is located above the base 11 of the guide pin module 10, the metal guide pin 12 and the conductive cover 20 are disposed at the mounting hole 91, an end of the conductive cover 20 protrudes from the circuit board 90, and the conductive cover 20 is bonded to the circuit board 90 by soldering.

By fixing and electrically connecting the conductive cover 20 to the metal guide pin 12, the metal guide pin 12 can be electrically connected to the circuit board 90 through the conductive cover 20. That is because the conductive cover 20 can be connected between the metal guide pin 12 and the circuit board 90 by soldering with a solder paste material. Therefore, the metal guide pin 12 made of a solder-repelling material (such as stainless steel or a niobium alloy) and the circuit board 90 can form a stable electrical connection state by the conductive cover 20, so as to achieve a stable resistance value of the connector 100 after assembly. In addition, this embodiment can further avoid inability to apply to a common solder paste soldering process due to solder repellence of metal in the conventional technology.

In this embodiment, the conductive cover 20 may be made of a high temperature resistant, non-oxidizing, and solderable material, such as zinc-tin-nickel alloy. In this way, other substances generated through high-temperature oxidation which affect the resistance and properties of the circuit board 90 and tin subsequently are avoided.

In this embodiment, the conductive cover 20 may be connected to and fixed on the top of the metal guide pin 12 through laser spot welding. Since the conductive cover 20 is made of a high temperature resistant and non-oxidizing material, the conductive cover 20 may be bonded and fixed to the metal guide pin 12 over a short period of time merely by placing the conductive cover 20 on the metal guide pin 12 and performing a laser spot welding process. Therefore, the guide pin module 10 may be placed on the conductive cover 20 and then fixed by applying a laser after the metal guide pin 12 is sintered with the glass sealing layer 13.

During the soldering, a lead-free solder paste 30 may be applied to a periphery of the conductive cover 20, where after the lead-free solder paste 30 is melted, the melted lead-free solder paste 30 flows around and fills the mounting hole 91, and part of the lead-free solder paste 30 flows into the mounting hole 91 (as shown in FIG. 2) and comes into contact with the circuit board 90, so as to form an electrical connection among the circuit board 90, the conductive cover 20, and the metal guide pin 12.

Refer to FIG. 3 to FIG. 5 in sequence to understand a manufacturing method of the connector 100 in this embodiment. It can be learned from FIG. 3 and FIG. 4 that the manufacturing method includes providing a guide pin module 10 (step S10). Structures and connection relationships of the guide pin module 10 are as described above, and details are not described herein again. Then a circuit board 90 is provided on one side of the guide pin module 10 (step S20). The circuit board 90 includes a mounting hole 91, and the metal guide pin 12 is inserted into the mounting hole 91.

Next, as shown in FIG. 3 and FIG. 5, a conductive cover 20 is disposed at the mounting hole 91, is connected to and fixed on the top of the metal guide pin 12, and protrudes from the circuit board 90 (step S30). In this embodiment, the conductive cover 20 may be sleeved on the top of the metal guide pin 12, and the conductive cover 20 may be connected to and fixed on the top of the metal guide pin 12 through laser spot welding. For example, the conductive cover 20 is placed on the metal guide pin 12, and the conductive cover 20 is soldered to the metal guide pin 12 through laser welding. In this embodiment, the conductive cover 20 is first placed on the top of the metal guide pin 12, and high-power heat energy is applied to the conductive cover 20 through a laser to cause part of the conductive cover to produce a high-temperature and then melt so as to be bonded to the top of the metal guide pin 12.

Then a soldering step is performed to bond the conductive cover 20 to the circuit board 90, so that the metal guide pin 12 is electrically connected to the circuit board 90 through the conductive cover 20 (step S40). In this way, the connector 100 shown in FIG. 2 can be completed. The soldering step may include: applying a lead-free solder paste 30 to a periphery of the conductive cover 20, and melting the lead-free solder paste 30 through heating, where after the lead-free solder paste is melted, the melted lead-free solder paste 30 flows around and fills the mounting hole 91 and part of the lead-free solder paste flows into the mounting hole 91, and the lead-free solder paste 30 comes into contact with the conductive cover 20, so that the metal guide pin 12 can be electrically connected to the circuit board 90 through the conductive cover 20.

Figure 6:
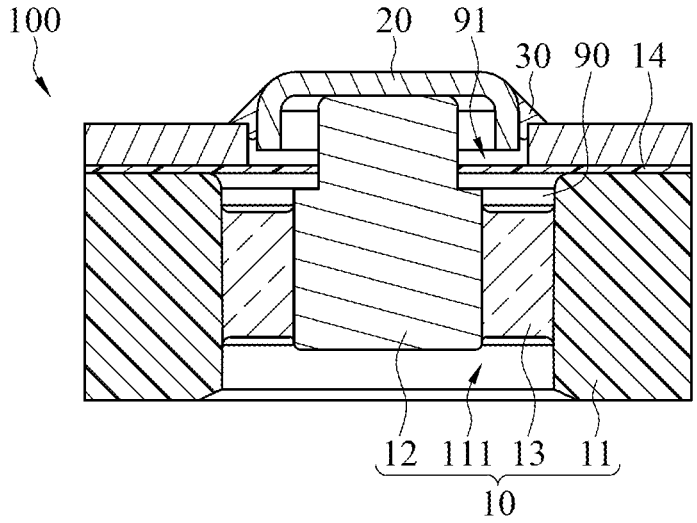
FIG. 6 is a partial cross-sectional view of a connector manufactured in a second embodiment of the application.

Next, referring to FIG. 6, FIG. 6 is a partial cross-sectional view of a connector manufactured in a second embodiment of the application. In this embodiment, the same parts as the previous embodiment are marked with the same element symbols, and the same structures and connection relationships are not described in detail herein again. It can be learned from FIG. 6 that the guide pin module 10 in this embodiment further includes an insulating layer 14 disposed above the glass sealing layer 13, surrounding the metal guide pin 12, and covering the perforation hole 111. In this embodiment, the insulating layer 14 is in a form of a patch. Before step S20, the insulating layer 14 may be first placed on an upper surface of the guide pin module 10. The insulating layer 14 may be in a form of a sheet, and holes are provided at a position corresponding to the metal guide pin 12. When the insulating layer 14 is placed on the upper surface of the guide pin module 10, the metal guide pin 12 is inserted into the holes to be attached to the upper surface of the guide pin module 10 to cover the perforation hole 111. In this way, short circuit caused when the lead-free solder paste 30 flows into the mounting hole 91 and directly comes into contact with the base 11 in step S40 can be avoided.

Figure 7:
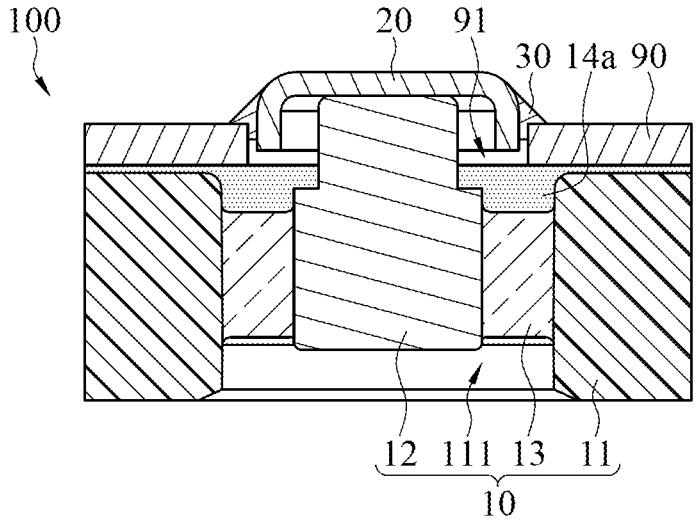
FIG. 7 is a partial cross-sectional view of a connector according to a third embodiment of the application.

In addition, referring to FIG. 7, FIG. 7 is a partial cross-sectional view of a connector according to a third embodiment of the application. In this embodiment, the same parts as the previous embodiment are marked with the same element symbols, and the same structures and connection relationships are not described in detail herein again. It can be learned from FIG. 7 that the guide pin module 10 in this embodiment further includes an insulating layer 14*a* disposed above the glass sealing layer 13, surrounding the metal guide pin 12, and covering the perforation hole 111. In this embodiment, the insulating layer 14*a* is in a form of coating. Before step S20, the insulating layer 14*a* may be applied to the upper surface of the guide pin module 10. The insulating layer 14*a* covers the entire upper surface of the guide pin module 10, and then covers the base 11, the perforation hole 111, and an upper surface of the glass sealing layer 13, and surrounds the metal guide pin 12. In this way, short circuit caused when the lead-free solder paste 30 flows into the mounting hole 91 and directly comes into contact with the base 11 in step S40 can be avoided.

In conclusion, the connector and the manufacturing method of a connector of the above embodiments of the application are applicable to processing and manufacturing of a guide pin module 10 having a glass-to-metal seal (GTMS) structure. The manufactured connector 100 can have biocompatibility, air tightness, and electrical performance. In addition, by adding the conductive cover 20 between the guide pin module 10 and the circuit board 90, even if a solder-repelling metal guide pin 12 made of stainless steel or a niobium alloy is used, the circuit board 90 can be electrically connected to the conductive cover 20 and the metal guide pin 12 of the guide pin module 10 by soldering.

In addition, by using the conductive cover 20 made of, for example, zinc-tin-nickel alloy, which is high temperature resistant and not easily oxidized, a laser may be applied on the top of the conductive cover 20 through laser spot welding to fix the conductive cover 20 to the metal guide pin 12.

Although the present application has been described in considerable detail with reference to certain preferred embodiments thereof, the disclosure is not for limiting the scope of the application. Persons having ordinary skill in the art may make various modifications and changes without departing from the scope and spirit of the application. Therefore, the scope of the appended claims should not be limited to the description of the preferred embodiments described above.

What is claimed is:

1. A connector configured to be disposed on a circuit board comprising a mounting hole, the connector comprising:

a guide pin module located on one side of the circuit board and comprising:

a base having a perforation hole corresponding to the mounting hole;

a metal guide pin inserted into the perforation hole and the mounting hole; and a glass sealing layer disposed at the perforation hole and wrapping around part of the metal guide pin; and a conductive cover disposed at the mounting hole, connected to a top of the metal guide pin and protruding from the circuit board, wherein the conductive cover is bonded to the circuit board by soldering, so that the metal guide pin is electrically connected to the circuit board through the conductive cover.

2. The connector according to claim 1, wherein the conductive cover is made of zinc-tin-nickel alloy.

3. The connector according to claim 1, wherein the metal guide pin is made of stainless steel or a niobium alloy.

4. The connector according to claim 1, wherein the conductive cover is made of a high temperature resistant, non-oxidizing, and solderable material.

5. The connector according to claim 1, wherein the conductive cover is connected to the top of the metal guide pin through laser spot welding.

6. The connector according to claim 1, wherein during the soldering, a lead-free solder paste is applied to a periphery of the conductive cover, and after the lead-free solder paste is melted, the melted lead-free solder paste flows around and fills the mounting hole and comes into contact with the circuit board, so as to form an electrical connection among the circuit board, the conductive cover, and the metal guide pin.

7. The connector according to claim 1, wherein the guide pin module further comprises an insulating layer disposed above the glass sealing layer, surrounding the metal guide pin, and shielding the perforation hole.

8. A manufacturing method of a connector, comprising:

providing a guide pin module, wherein the guide pin module comprises a base, a metal guide pin, and a glass sealing layer, wherein the base comprises a perforation hole, the metal guide pin is inserted into the perforation hole, and the glass sealing layer is disposed at the perforation hole and wraps around part of the metal guide pin;

providing a circuit board on one side of the guide pin module, wherein the circuit board comprises a mounting hole corresponding to the perforation hole, and the metal guide pin is inserted into the mounting hole;

disposing a conductive cover at the mounting hole, wherein the conductive cover is connected to a top of the metal guide pin and protrudes from the circuit board; and performing a soldering step to bond the conductive cover to the circuit board, so that the metal guide pin is electrically connected to the circuit board through the conductive cover.

9. The manufacturing method according to claim 8, wherein the conductive cover is made of zinc-tin-nickel alloy.

10. The manufacturing method according to claim 8, wherein the metal guide pin is made of stainless steel or a niobium alloy.

11. The manufacturing method according to claim 8, wherein the conductive cover is made of a high temperature resistant, non-oxidizing, and solderable material.

12. The manufacturing method according to claim 8, wherein the conductive cover is connected to the top of the metal guide pin through laser spot welding.

13. The manufacturing method according to claim 8, wherein the soldering step comprises:

applying a lead-free solder paste to a periphery of the conductive cover; and melting the lead-free solder paste through heating, wherein after the lead-free solder paste is melted, the melted lead-free solder paste flows around and fills the mounting hole and comes into contact with the circuit board, so as to form an electrical connection among the circuit board, the conductive cover, and the metal guide pin.

14. The manufacturing method according to claim 8, wherein the guide pin module further comprises an insulating layer disposed above the glass sealing layer, surrounding the metal guide pin, and shielding the perforation hole.

* * * * *